US009248452B2

(12) United States Patent
Hart et al.

(10) Patent No.: US 9,248,452 B2
(45) Date of Patent: Feb. 2, 2016

(54) AGITATION APPARATUS WITH INTERCHANGEABLE MODULE AND IMPACT PROTECTION USING REACTIVE FEEDBACK CONTROL

(76) Inventors: Brendan George Hart, Troy, NY (US); Ian Keith Glasgow, Averill Park, NY (US); David Grinnell, Averill Park, NY (US)

( * ) Notice: Subject to any disclaimer, the term of this patent is extended or adjusted under 35 U.S.C. 154(b) by 326 days.

(21) Appl. No.: 13/226,339

(22) Filed: Sep. 6, 2011

(65) Prior Publication Data

US 2013/0058187 A1 Mar. 7, 2013

(51) Int. Cl.

| | |
|---|---|
| ***B01F 7/00*** | (2006.01) |
| ***B01L 9/06*** | (2006.01) |
| ***B01F 9/00*** | (2006.01) |
| ***B01F 7/16*** | (2006.01) |
| ***B01F 11/02*** | (2006.01) |

(52) U.S. Cl.

CPC ..... *B01L 9/06* (2013.01); *B01F 7/1695* (2013.01); *B01F 9/0021* (2013.01); *B01F 11/0275* (2013.01); *B01L 2200/025* (2013.01); *B01L 2200/085* (2013.01); *B01L 2300/0803* (2013.01); *B01L 2300/123* (2013.01)

(58) Field of Classification Search

CPC ..... B04B 1/14; B01F 9/0021; B01F 7/1695

USPC ..... 366/197, 214, 273, 274, 198; 494/10, 494/16

See application file for complete search history.

(56) References Cited

U.S. PATENT DOCUMENTS

| | | | | |
|---|---|---|---|---|
| 3,677,380 | A * | 7/1972 | Kirschey | 192/105 BA |
| 4,226,669 | A * | 10/1980 | Vilardi | 159/6.1 |
| 5,242,370 | A * | 9/1993 | Silver et al. | 494/11 |
| 5,382,219 | A * | 1/1995 | Malekmadani | 494/16 |
| 5,769,538 | A * | 6/1998 | Sherman et al. | 366/198 |

* cited by examiner

*Primary Examiner* — Tony G SooHoo
*Assistant Examiner* — Anshu Bhatia

(57) ABSTRACT

An apparatus for agitating materials contained in tubes, including cellular materials and tissues, to release their contents for scientific analysis. The apparatus includes a control enclosure containing a base and a motor, and an interchangeable module that connects to the motor. The interchangeable module includes a tube supporting structure and a rotatable hub connected to one or more strikers positioned to impact the tubes, resulting in agitation of tube contents. Interchangeable modules allow for different shapes and sizes of tubes to be used with a single control enclosure. The apparatus includes a means to measure the rotational velocity of the rotatable hub and the rotational velocity of the strikers. The apparatus further includes protective sleeves for the tubes to prevent breakage, heat build-up from friction and tube caps opening due to rapid impact from strikers.

17 Claims, 8 Drawing Sheets

Figure 1A:
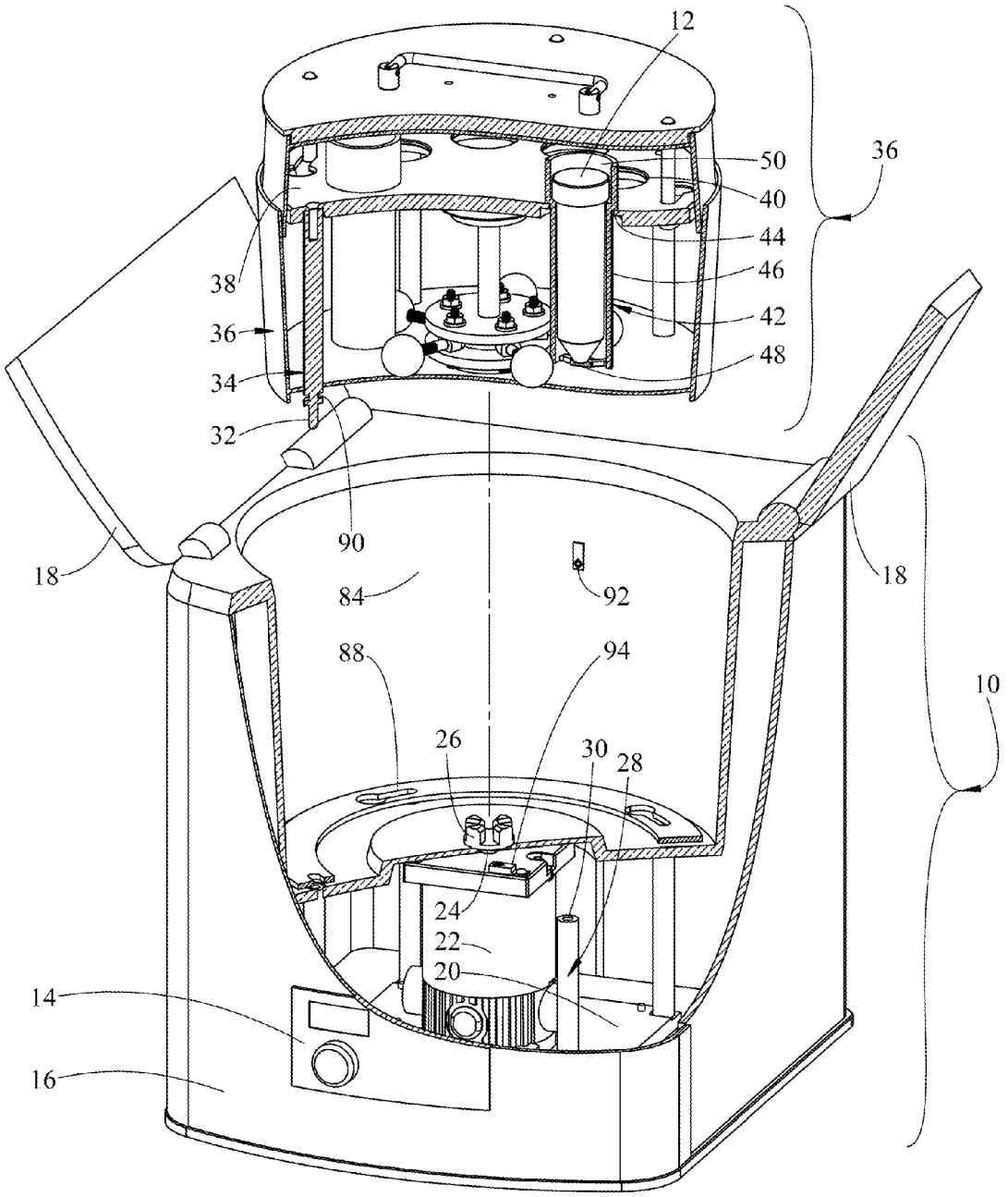

AGITATION APPARATUS WITH INTERCHANGEABLE MODULE AND IMPACT PROTECTION USING REACTIVE FEEDBACK CONTROL

BACKGROUND

Prior Art

The following lists some prior art which presently appears relevant:

| U.S. Patent | | |
|---|---|---|
| Patent Number | Issue Date | Patentee |
| 5,769,538 | 1998 Jun. 23 | Sherman |
| 6,281,005 | 2001 Aug. 28 | Casal |
| 7,866,878 | 2011 Jan. 11 | Howe |
| 7,874,719 | 2011 Jan. 25 | Markle |
| 5,464,773 | 1995 Nov. 7 | Melendez |

Disruption of cells and tissues is a common procedure carried out in biology laboratories to release nucleotides, proteins, virus, small molecules, chemicals, or whole cells for scientific analysis. It is often desirable to disrupt many samples simultaneously in individual tubes or containers to avoid cross contamination and to save time. A striking technology has been described to mechanically disrupt substances in tubes (U.S. Pat. No. 5,769,538 to Sherman). This technology is based on strikers that rotate around a hub or an axis and rapidly contact the tubes with contents inside. The impact of the strikers on the tubes induces turbulent motion of the contents, resulting in mixing, resuspension, homogenization or disruption of the tube contents.

The thoroughness of the mixing, resuspension, homogenization or disruption of the substances depends upon the force and frequency that the strikers impact the tube. Tubes made of plastic or another brittle material may crack or break on impact, splattering contents and risking cross-contamination of other tubes. In addition, the cap on the tube may loosen or completely open. The area of impact of the strikers on the tube will also affect the performance of the striking technology. If the tube is struck in a position that is too high or too low, momentum transfer between the striker and the tube may not be sufficient, or the tube may crack. If the height of strikers on the axis/hub is non-adjustable, the striking technology can only be used with one tube size or shape.

In addition, the Sherman patent called for an upper and lower plate to hold the tubes in place, limiting the movement of the tubes and thus limiting the agitation of the tube contents. Because of these conditions, a user who wanted to use several different tube sizes would need a separate model specifically designed for each tube type. Multiple models would inconvenience the user with significant extra cost and require extra laboratory space. Keeping extra units in storage to save space would only increase time lost to equipment set up.

In the prior art, a motor connected to the hub provides the rotational movement that controls the force and frequency at which the strikers impact the tubes. As the number of tubes in the prior art increases the rotational velocity of the motor will decrease. We have found that the hub will rotate at a faster speed when unimpeded than when the strikers come in contact with tubes. The tubes give resistance which opposes the rotational velocity of the motor. With a greater number of tubes in the prior art's mixer, each tube will receive fewer or weaker impacts compared to a lesser number of tubes. This results in a reduction of thoroughness of disruption/mixing of tube contents. Inversely if a tube breaks, the resistance felt by the strikers will decrease. This would result in faster rotation of the strikers. This increasing speed would increase the risk of additional tubes breaking. Tubes with samples of larger mass would also create more resistance for the motor, and decreasing the prior art's effectiveness. The prior art lacks a form of feedback to detect tubes breaking, and control the speed for a desired level of impact. In addition, the prior art has no way to compensate for the mass or viscosity of the samples in the tubes We have found that an issue experienced by the prior art was a build-up of heat within the tubes due to friction from direct impacts by the strikers. Heat rising within samples can create adverse conditions for some methods of scientific analysis. Additionally, we have found that impacts on tubes result in a very loud running volume. The user may experience an uncomfortable level of noise, often times too loud to hold a normal conversation while in close proximity. Many users preferred to be in another room while the units ran. Covering the unit would reduce the noise but doing this would exacerbate heat build-up by restricting or limiting ambient air.

It would be desirable to have a device to protect the tubes while they receive maximum force from the strikers for effective mixing, resuspension, homogenization or disruption. In addition, it would be desirable for the striking technology to conveniently allow for different sizes, shapes and quantities of tubes while protecting the tubes from breaking and ensuring that each tube receives the desired striking impact at the optimal position regardless of the number of tubes present in the unit. It would also be desirable to reduce both the heat build-up on tubes, and the loud running noise.

Advantages

Accordingly, several advantages of one or more aspects of the current invention are as follows: protection of the sample tube from the impacts, thus allowing more frequent impacts and impacts of greater magnitude, limitation of caps loosening, reduction of heat build-up, reduction of noise, interchangeability of sample tubes, consistent performance, automatic shut-off in the case of a tube failure. Further advantages of one or more aspects of the current invention will become apparent from a consideration of the drawings and the detailed disclosure.

Summary

One or more aspects of the present invention provide a protective sleeve with a space allotted for a tube. The energy from the impact of the strikers onto the protective sleeve will be transferred to the tube over a larger surface area, allowing the tube to be impacted without sustaining damage or having the cap loosened or opened. In an embodiment, the open base and material composition allow for the sleeve to deform upon impact, increasing the momentum transfer from the striker to the tube. The protective sleeve will protect tubes from impacting strikers inside of an agitation apparatus. Additionally this extra layer of protection will reduce heat build-up in the tubes due to friction from impacting strikers.

Another aspect of the present invention provides a removable module able to hold a set number of tubes. In an embodiment, the module contains a rotatable hub shaft with strikers. The module fits inside of a base unit or control enclosure containing a motor. The hub shaft in the module attaches to the motor in the base unit, providing rotational movement to spin the strikers around the rotatable hub and strike the tubes. Multiple interchangeable modules accommodating different sized tubes or placement configurations can be used with a single control enclosure. The control enclosure uses a sensor to identify the module that is inserted and adjusts the operational parameters for the type of tubes used in said module.

Having multiple interchangeable modules with a single control enclosure is convenient and cost effective compared to having several standalone apparatuses. In an embodiment, the module, located inside the control enclosure, provides a layer of sound isolation close to the source of the noise. The control enclosure provides a second layer of sound isolation, thereby reducing the level of noise observed by the user.

Another aspect of the present invention provides a method for adjusting the magnitude or frequency of the impacts, based upon the load, which includes the number of tubes and the mass of the content in them. Additionally the invention has the ability to sense when a tube has broken and stop the apparatus from running.

DRAWINGS

Figures

FIG. 1*a* shows a diametric view, in accordance with one embodiment, of a protective sleeve for a tube, a detachable module containing a striking mechanism and a control enclosure for retaining and controlling the module. Hatched lines show cut away portions for a clearer illustration of the internal geometry.

Figure 1B:
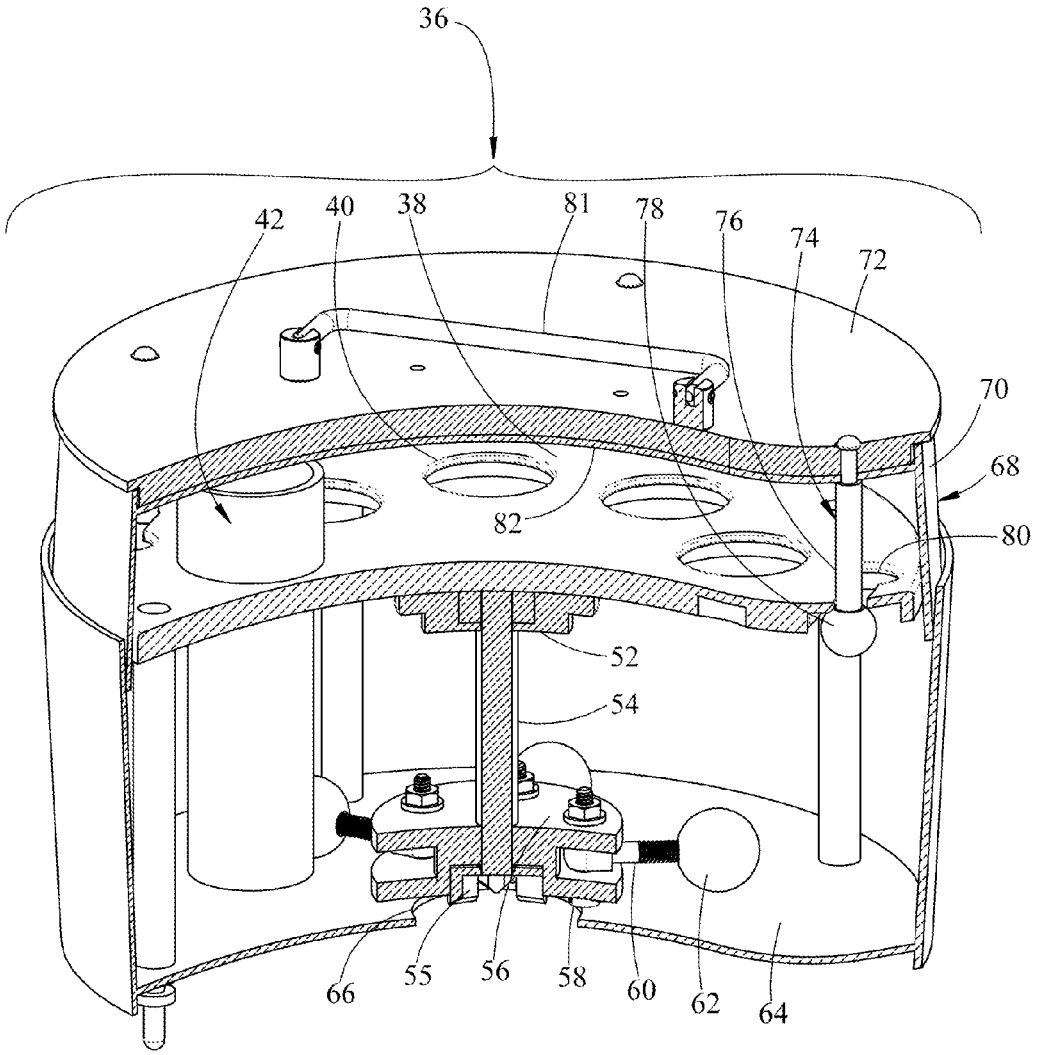

FIG. 1*b* shows a diametric view of the module. Hatched lines show cut away portions for a clearer illustration of the internal geometry.

Figure 1C:
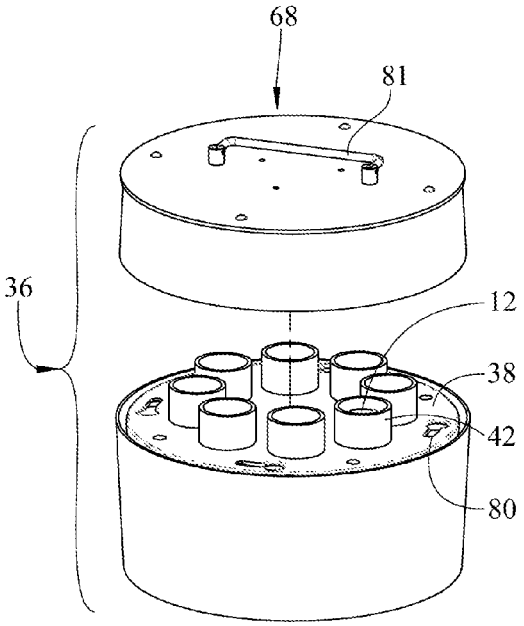

FIG. 1*c* shows the module in its open configuration, and loaded with eight protective sleeves.

Figure 1D:
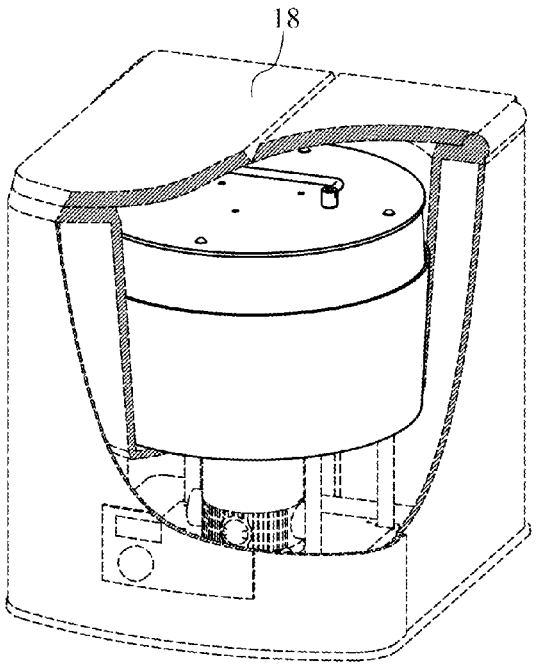

FIG. 1*d* shows the module inserted or installed in the base unit. Hatched lines show cut away portions for a clearer illustration of the internal geometry.

Figure 1E:
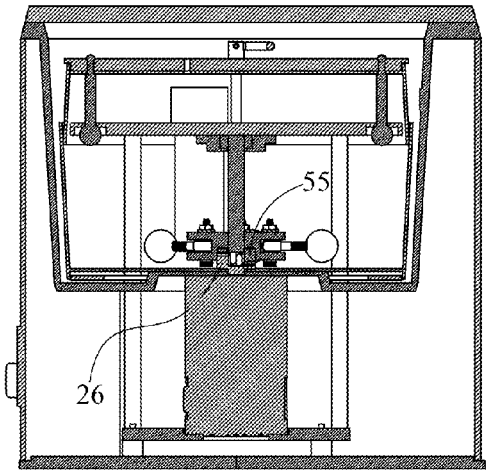

FIG. 1*e* shows a side cut away view of the module inserted into the base unit. Hatched lines show cut away portions for a clearer illustration of the internal geometry.

Figure 2A:
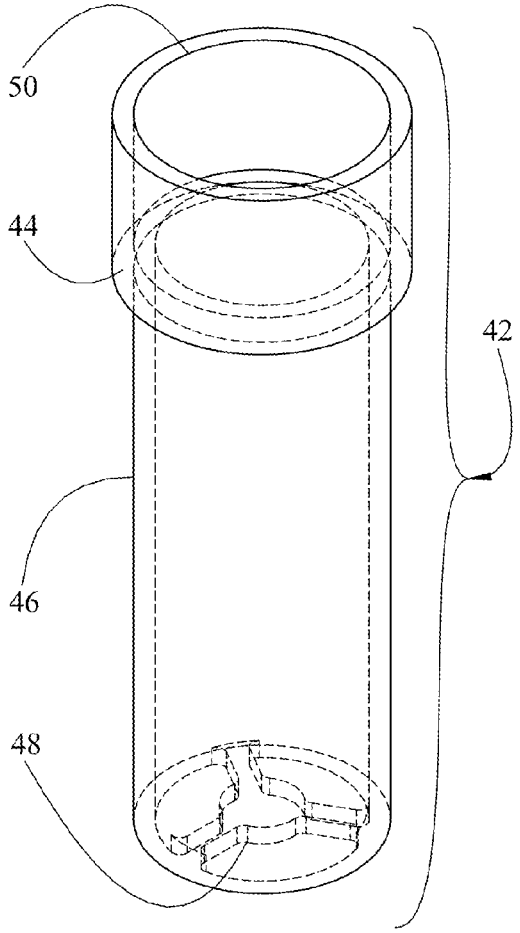

FIG. 2*a* shows an isometric view of the protective sleeve for a tube, with hidden lines shown dotted, in accordance with one embodiment.

Figure 2B:
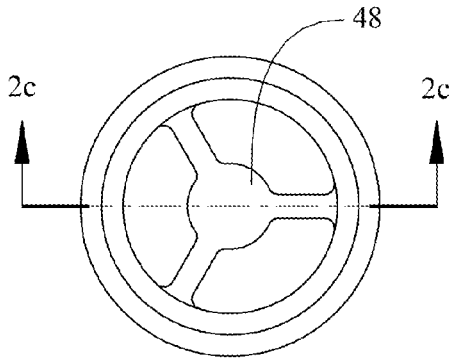

FIG. 2*b* shows a top view of the protective sleeve in accordance with one embodiment.

Figure 2C:
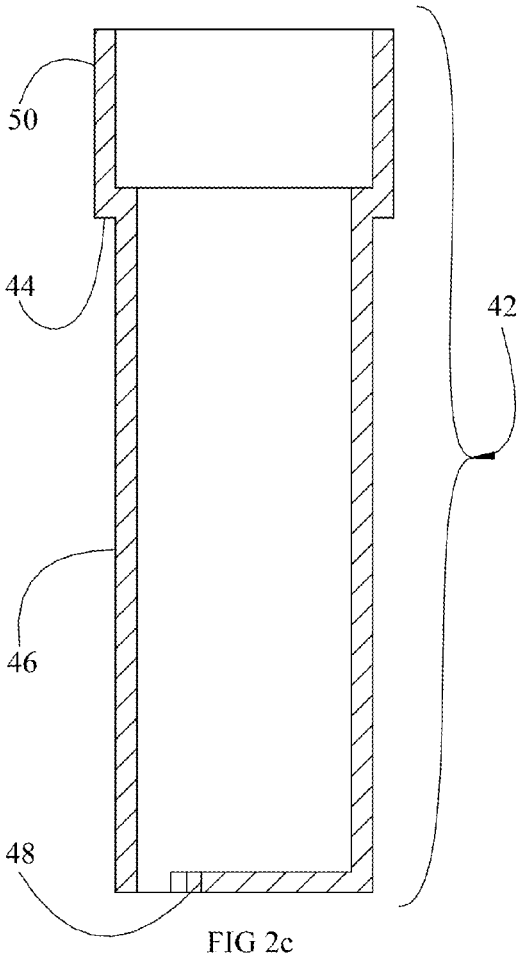

FIG. 2*c* shows a cross sectional view of the protective sleeve in accordance with one embodiment.

Figure 3A:
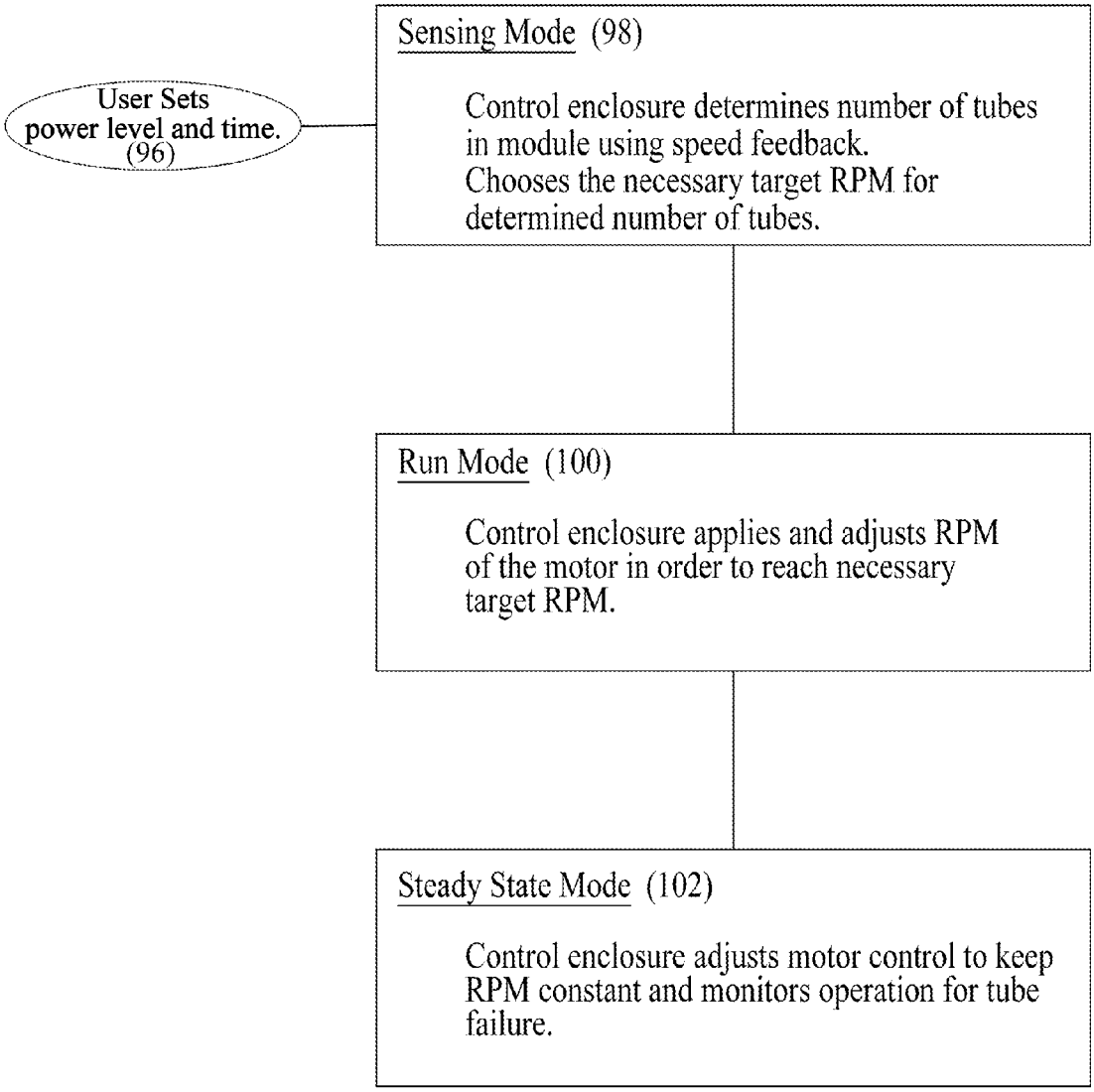

FIG. 3*a* shows a general flow chart for the method in which the electronics control the speed of the strikers.

Figure 3B:
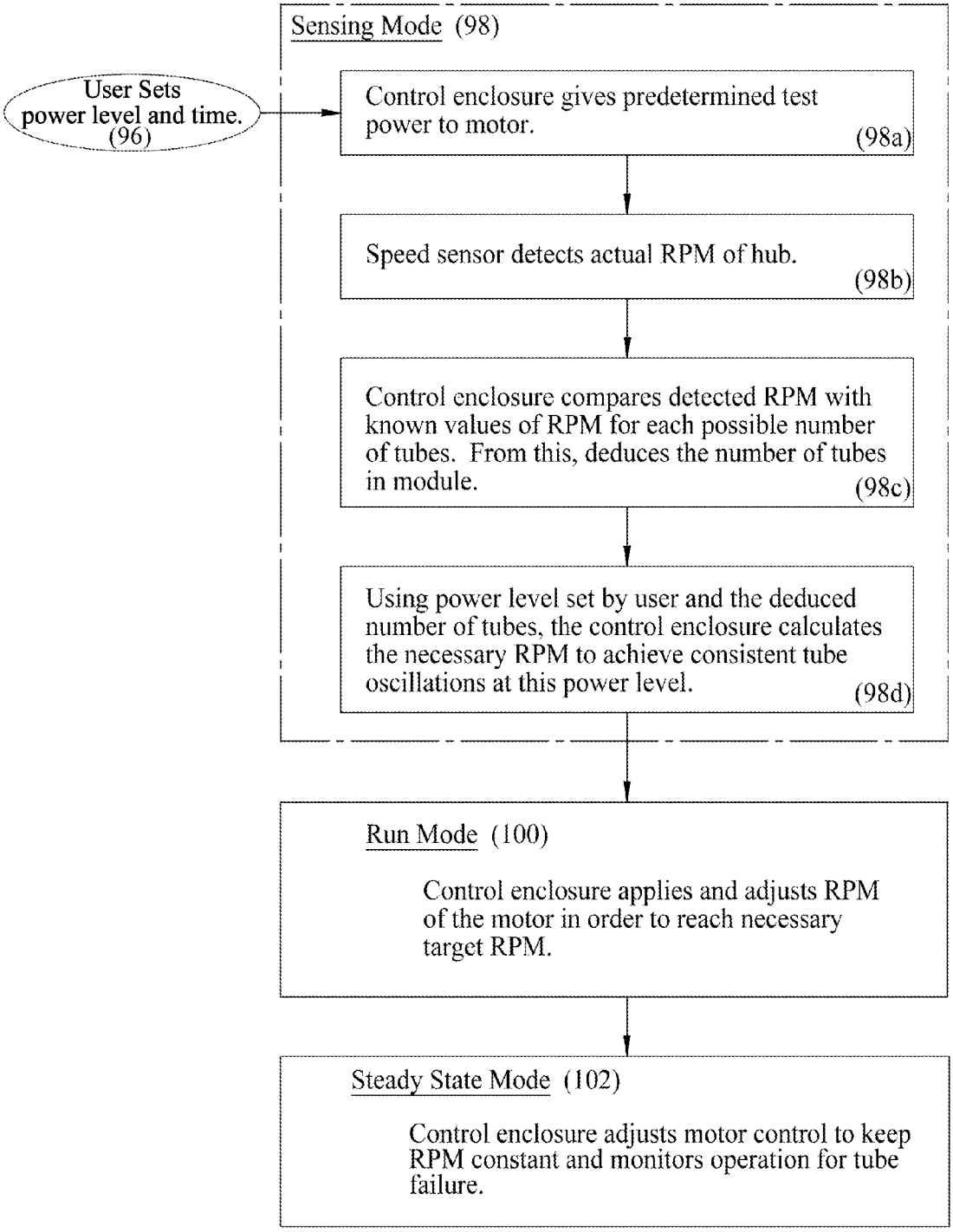
Figure 3C:
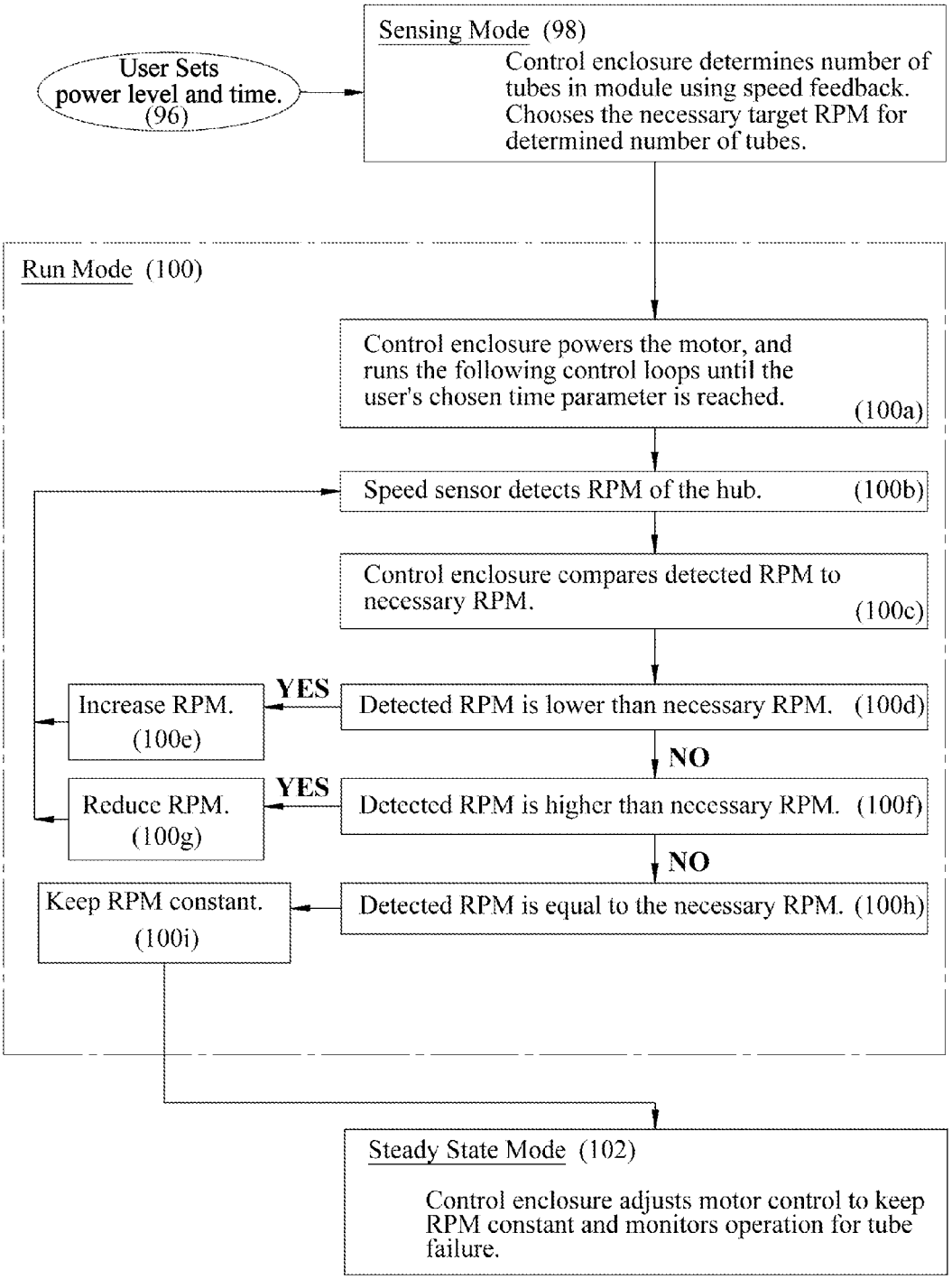
Figure 3D:
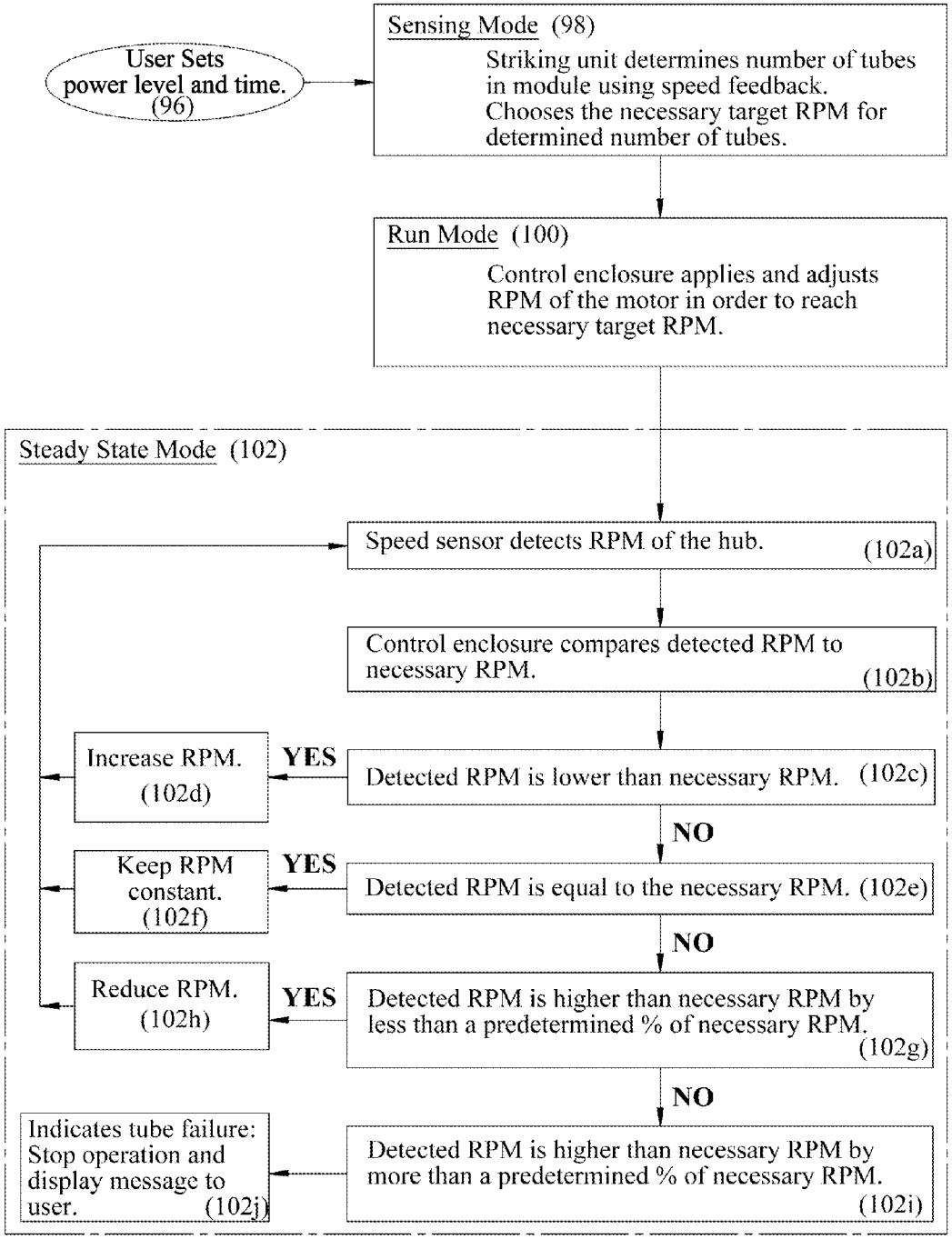

FIGS. 3*b* to 3*d* show more particularized flow charts for the method in which the electronics control the speed of the strikers.

| Drawings - List of Reference Numerals | |
|---|---|
| 10 | Control enclosure |
| 12 | Tube |
| 14 | User controls |
| 16 | Outer housing |
| 18 | Outer lid |
| 20 | Motor mounting plate |
| 22 | Variable speed electric motor |
| 24 | Motor shaft |
| 26 | Lower disconnecting coupling half |
| 28 | Bottom standoffs |
| 30 | Guide hole |
| 32 | Guide pin |
| 34 | Upper standoffs |
| 36 | Module |
| 38 | Sleeve holding plate |

-continued

| Drawings - List of Reference Numerals | |
|---|---|
| 40 | Cylindrically cut holes |
| 42 | Protective sleeve |
| 44 | Flange |
| 46 | Tubular main cylinder |
| 48 | Tube retaining platform |
| 50 | Cap sleeve |
| 52 | Flanged bearing |
| 54 | Rotatable hub shaft |
| 55 | Upper disconnecting coupling half |
| 56 | Rotatable hub |
| 58 | Shoulder bolts |
| 60 | Pendulum arm |
| 62 | Strikers |
| 64 | Module catch basin |
| 66 | Coupling access port |
| 68 | Module lid |
| 70 | Upper shroud |
| 72 | Lid plate |
| 74 | Retaining arms |
| 76 | Thin shaft |
| 78 | Ball end |
| 80 | Slotted hole |
| 81 | Handle |
| 82 | Retaining plate |
| 84 | Module cavity |
| 88 | Module locking mechanism |
| 90 | Upper standoff grooves |
| 92 | Module sensor |
| 94 | Speed sensor |
| 96 | User input settings |
| 98 | Sensing Mode |
| 100 | Run Mode |
| 102 | Steady state mode |

DETAILED DESCRIPTION

First Embodiment

FIGS. 1*a-d*, 2*a-c* and 3*a-b*

One embodiment of the present invention is illustrated in FIG. 1*a-d*, 2*a-c* and 3*a-b*. FIG. 1*a* shows an instrument or control enclosure 10 for impacting tubes 12; causing frequent oscillations and energetic movement for said tubes 12. The control enclosure 10 refers to several elements acting as a stationary base. The control enclosure 10, contains the electronics (not shown), and internal components. The main body of the control enclosure 10 is an outer housing 16. The front of the outer housing 16 has user controls or user interface 14. The top of the outer housing 16 has an outer lid or cover 18, which splits opening from the center and hinged on the top of the outer housing's 16 right and left sides.

Mounted to the inside of the outer housing 16 on the bottom face is a motor mounting plate 20. A variable speed electric motor 22 is affixed to the center of the motor mounting plate 20. A drive shaft 24 projects upward to a lower disconnecting coupling half 26. Extending vertically upward from the motor mounting plate 20 are four bottom standoffs or supports 28.

Each of the bottom standoffs 28 contain a guide hole 30 on their top face which aligns with a pin 32 on the underside of a set of four upper standoffs 34. The upper standoffs 34 act to guide a removable assembly or module 36 into the control enclosure 10.

In the module 36, affixed to the other end of the upper standoffs 34, is a sleeve holding plate 38. In this embodiment, the sleeve holding plate 38 has multiple cylindrically cut holes 40 in its surface. Several cylindrically cut holes 40 are not shown due to the cut away view.

Within each cylindrically cut hole 40 hangs a removable protective casing or protective sleeve 42. In this embodiment, shown in FIGS. 1*a* and 2*a-c*, the protective sleeve 42 is one continuous piece of plastic or other strong and flexible material. The protective sleeve 42 is comprised of several features or parts. The protective sleeve 42 hangs by a flange or lip 44 which is larger in diameter than the cylindrically cut hole 40. The protective sleeve 42 has a main tubular cylinder 46 affixed to the flange 44. The main tubular cylinder 46 extends vertically down through the cylindrically cut hole 40. The main tubular cylinder 46 is smaller in diameter than the cylindrically cut hole 40. At the bottom of the main tubular cylinder 46 is an affixed flexible tube retaining platform 48 Sitting on the tube retaining platform 48 rests the bottom of a tube 12. The tube retaining platform 48 functions to hold the tube 12 in an optimal position within the protective sleeve 42. In this embodiment, the tube retaining platform 48 is comprised of three thin spokes; shown in FIG. 2*a-c*. This geometry allows the tube retaining platform 48 to remain flexible. When the tubular cylinder 46 is impacted, it will deform from a circular opening to an ellipse. The spokes comprising the tube retaining platform 48 add very little rigidity to the tubular cylinder 46 since they are thin and not in line with each other; easily bending to allow the tubular cylinder 46 to be deformed. From the flange 44 extends upward a vertical cylindrical wall, or cap sleeve 50. The cap sleeve 50 extends beyond the height of the tube 12. The protective sleeve 42 fits loosely in the cylindrically cut hole 40, so the protective sleeve 42 is able to rock or pivot within the cylindrically cut hole 40.

The following refers to FIG. 1*b*, showing the module 36 in more detail. Centered and bolted to the underside of the sleeve holding plate 38, is a flanged bearing 52. A rotatable hub shaft 54 within the flanged bearing 52 extends vertically downward, ending in an upper disconnecting coupling half 55. Located at a specific distance down from the sleeve holding plate 38 is a rotatable hub 56 fixed to the rotatable hub shaft 54. In this embodiment the rotatable hub 56 has five positions for shoulder bolts or pins 58. The shoulder bolts 58 are on a bolt circle concentric with the rotatable hub shaft 54. Each shoulder bolt 58 pins a pendulum arm 60 which can rotate around the axis of each attached shoulder bolt 58. Fastened to the end of each pendulum arm 60 is a striker, hammer, or weighted mass 62. As the hub 56 rotates, the strikers 62 pivot to their fully extended form, and have an intersecting path with the bottom of the protective sleeves 42. The distance between the rotatable hub 56 and the sleeve holding plate 38 is such that the area of impact of the strikers 62 on the tube 12 or the protective sleeve 42 results in sufficient momentum transfer for effective mixing of tube contents. The distance between the rotatable hub 56 and the sleeve holding plate 38 will vary depending upon the size and shape of the tube 12 or protective sleeve 42 that is intended for use in the module 36. If different sized tubes 12 are required by the user, a different module 36 may be used in the control enclosure 10.

Enclosing the module 36 and extending down from the tube holding plate 38, is a module catch basin 64. The module catch basin 64 envelopes the lower half of the module 36 and has an opening or coupling access port 66 centered at its bottom to expose the upper disconnecting coupling half 55. Enclosing the upper half of the module 36 is a module lid 68, shown detached in FIG. 1*c*. The module lid 68 is comprised of several parts, shown in FIG. 1*b*. Radially surrounding the upper half of the module 36 is an upper shroud 70. The bottom edge of the upper shroud 70 fits into the top of the module catch basin 64. A lid plate 72 retains the upper shroud 70 in place. From the underside of the lid plate 72 extends four vertically hanging retaining arms or locking mechanism 74. The retaining arms 74 have a thin shaft 76 which joins to a larger ball end 78. Each retaining arm 74 extends through a slotted hole 80 located along the perimeter of the sleeve holding plate 38. Using a handle 81 on the top of the lid plate 72, a user can turn or rotate the module lid 68 clockwise (with respect to the stationary sleeve holding plate 38) to lock said module lid 68 in place. Fastened to the underside of the lid plate 72, above the protective sleeves 42, is a hardened contact retaining plate 82. The retaining plate 82 acts as a hard stop to limit the travel of the protective sleeves 42, and prevents the protective sleeves 42 from ejecting from the cylindrically cut holes 40.

Referring back to FIG. 1*a* shows the control enclosure 10 has a void, space, or module cavity 84 for the module 36 to be inserted, or installed. When the module 36 is inserted into the control enclosure's 10 module cavity 84 the pins 32 on the upper standoffs 34 will align with the holes 30 in the bottom standoffs 28, guiding the module 36 into place. A module locking mechanism 88 will secure the module 36 in place by rotating clockwise around its central axis. The module locking mechanism 88 will interlock with grooves on the upper standoffs 90. When the module 36 is fully inserted into the control enclosure 10 the two disconnecting coupling halves 26 & 55 will interlock together, shown in FIG. 1*e*. These disconnecting couplings 26 & 55 will mate to form a mechanical connection between the hub shaft 24 and the motor shaft 54. FIG. 1*d* and 1*e* show the module 36 installed in the control enclosure 10.

Referring back to FIG. 1*a*, a module sensor 92 affixed to the module cavity 84 will detect the presence of the module 36, and the module's version. A hub sensor or speed sensor 94 measures the speed of the rotating hub 56 and strikers 62, as the unit runs. In this embodiment, the speed sensor 94 is mounted to the top of the motor 22; shown in FIG. 1*a*.

Operation

A first embodiment of the control enclosure 10 allows for interchangeable modules to be installed. A user chooses a module such as the module 36 shown in this embodiment. Opening the outer lid 18 the user lowers the module 36 into the module cavity 84, aligning the upper standoff pins 32 with the lower standoffs 28. When the module 36 is in its lowest seated position, the coupling halves 26 & 55 will mate, forming a physical connection from the motor shaft 24 to the hub shaft 54. FIGS. 1*d* and 1*e* show the module 36 installed in the control enclosure 10.

The module sensor 92, shown in FIG. 1*a*, will detect the type of module 36 installed and confirm that it is aligned correctly within the module cavity 84. The module sensor 92 uses a radio frequency identification tag (not shown), magnets (not shown) or other sensor flags (not shown) installed on the module, which are well known to a person of ordinary skill in the art. The control enclosure 10 will then secure the module 36 in place by rotating the module locking mechanism 88.

Using the handle 81 the user then rotates the module lid 68 and lifts up from the module 36, revealing the sleeve holding plate 38. An open module 36 is shown in FIG. 1*c*. The user then inserts tubes 12 into the protective sleeves 42. Extra protective sleeves 42, not in use, may be lifted out and removed from the module 36. The module lid 68 is then secured by aligning the retaining arms 74 with the slotted holes 80 in the sleeve holding plate 38, and rotating clockwise. Shown in FIG. 1*d*, the outer lid 18 is then closed.

The action of the tubes' 12 agitation is described here. When the motor 22 is powered by the electronics (not shown, but known to a person of ordinary skill in the art), it rotates the attached hub 56. This spinning will extend the pendulum arms 60 and strikers 62. The extended pendulum arms 60 impact the side of the tubular main cylinder 46. From this impact the protective sleeve 42 tilts away from the spinning strikers 62.

The control enclosure 10 creates an oscillating motion for the tubes 12. The action of tube oscillations is achieved from the frequent impacts on the protective sleeves 42. Upon impact each protective sleeve 42 pivots at the cylindrically cut hole 40, tilting the bottom of the protective sleeve 42 away from the strikers 62. Space between the cylindrically cut hole 40 and the main tubular cylinder 46 allows for this rocking motion. The protective sleeve 42 rocks away or recoils from the strikers 62 until its movement is stopped by the cap sleeve 50 coming into contact with the stationary retaining plate 82. The retaining plate 82 acts as a hard stop to restrict unnecessary excess movement of the protective sleeves 42, and prevent the protective sleeve 42 and its contained tube 12 from ejecting themselves from the sleeve holding plate 38.

The protective sleeve 42 will rebound from the retaining plate 82 and return to its vertically oriented position. As the protective sleeve 42 rights itself vertically it will enter the impact zone of the strikers 62 again. The tube 12 contained within the protective sleeve 42 rapidly and forcefully shakes as the protective sleeve 42 is repeatedly struck by the strikers 62, causing the protective sleeve 42 to recoil then rebound from the retaining plate 82.

The strikers 62 also rebound after impacting the protective sleeve 42. Each striker 62 attached to a pendulum arm 60 pivots out of the impact zone after making contact with the protective sleeve 42. This recoiling action serves to extend the life of the internal components as well as to prevent the pendulum arms 60 from jamming, causing motor 22 seizures. As the hub 56 continues to spin the pendulum arms 60 will return to their out stretched normal position. In this outstretched position, the striker 62 will impact another protective sleeve 42 and repeat the cycle.

In this embodiment, the rotational velocity of the motor shaft 24 is controlled by applying power to the motor 22 by means of pulse width modulation, which is well known in the art. To change the rotational velocity of the motor shaft 24, the control enclosure 10 changes the duty cycle of voltage pulses applied to the motor 22. The control enclosure provides an adjusted electronic control to the motor. An increase in duty cycle will increase the rotational velocity of the motor shaft 24, while a decrease in duty cycle will decrease the rotational velocity of the motor shaft 24.

The method in which the control enclosure applies and controls the motor 22 is described in FIG. 3*a*. In this embodiment there are three modes: sensing mode (98), run mode (100) and steady state mode (102), which are each expanded in FIGS. 3*b* to 3*d*. FIG. 1*a* shows the physical components (numbers 10-94) while FIG. 3*a* to FIG. 3*d* (numbers 96-102) shows the process or method in which the control enclosure 10 controls the strikers 62. To begin, the user will select a desired power level and duration 96 with the user controls 14. The control enclosure 10 utilizes the illustrated method or process in FIG. 3*a* to achieve consistent striking force and frequency matching the user's desired power level 96. The control enclosure 10 will increase or decrease the RPM (revolutions per minute) of the strikers 62 based on the number of tubes 12 in the module 36 and the user's selected power level.

To obtain the number of tubes in the module 36 the control enclosure 10 will begin running in sensing mode 98, shown in FIG. 3*b*. Sensing mode 98 begins with the motor 22 being given a predetermined test power 98*a*. This predetermined test power is independent from the user's desired power level 96. This test power rotates the motor shaft 24 and the attached hub 56 for a predetermined amount of time. During this time, the speed sensor 94 detects the hub's RPM 98*b*. Depending upon the amount of tubes 12 in the module 36 the RPM of the strikers 62 will vary for the predetermined test power 98*a* given to the motor 22. Each possible number of tubes 12 corresponds with a known RPM range. The control enclosure 10 compares the detected RPM with these known RPM ranges. This step in the method 98*c* determines the amount of tubes 12 in the module 36.

Using the determined number of tubes 98*c* and the user's selected power level 96, the control enclosure 10 performs a mathematical calculation and selects the necessary target RPM for the strikers 62 to achieve an appropriate and consistent frequency of tube oscillations 98*d*, which becomes the set point for the control enclosure 10. Strikers 62 with rotational velocity matching the RPM of this set point 98*d* will give consistent results for each user selected power level 96.

The control enclosure 10 then enters run mode 100, shown in FIG. 3*c*. During run mode 100 the control enclosure 10 applies power to the motor 22 which drives the hub 56 and strikers 100*a*. On a specified time interval the control enclosure 10 samples the RPM of the hub 56 using the speed sensor 100*b*, which is part of the sensing circuit (not shown). The observed RPM is compared to the necessary target RPM 100*c*. If the observed RPM is less than the necessary target RPM 100*d* the control enclosure 10 will increase the RPM of the hub 100*e*. If the observed RPM is greater than the necessary target RPM 100*f* the RPM of the hub will be decreased 100*g*. Once the observed RPM is acceptably close to the necessary target RPM 100*h*, the control enclosure will keep the RPM of the hub 56 constant 100*i*, and the control enclosure 10 will move on to Steady State Mode 102.

During Steady State Mode 102, shown in FIG. 3*d*, at each specified time interval, the control enclosure 10 samples the RPM of the hub using the speed sensor 102*a*. The observed RPM is compared to the necessary target RPM 102*b*. If the observed RPM is less than the necessary target RPM 102*c* the control enclosure 10 will apply a greater voltage 102*d*. If the observed RPM is equal to the necessary target RPM 102*e* the control enclosure will keep the RPM of the hub 56 constant 102*f*. If the observed RPM is greater than the necessary target RPM 102*g* by less than a specified percentage the RPM of the hub 56 will be decreased 102*h*. If the observed RPM is greater than the necessary target RPM by over a specified percentage 102*i*, a tube 12 failure is indicated 102*j*. This may happen if a tube 12 or protective sleeve 42 is ejected from the cylindrically cut hole 40 or broken. At this point the control enclosure 10 will stop the strikers from rotating and alert the user to check the module for a potential fault 102*j*.

Description and Operation of Alternative Embodiments

The following additional embodiments are described, without limiting the scope of the invention from further variations that can be easily determined.

There could be other methods of controlling the motor speed, including, but not limited to pulse width modulation, frequency of pulses, voltage control, and/or electrical current, which are all well known in the art.

An electronic sensing circuit, possibly with an optical sensor or magnetic sensor or capacitive sensor could be used to determine the movement of the rotatable hub or the velocity of the individual strikers or the magnitude or velocity of the rebound of the strikers after they impact the tubes. Alternatively, the sensing circuit could monitor the electrical emissions or radio frequency emissions from the motor. Any number of feedback controls could compensate for the velocity of the hub or the speed of the individual strikers or the rebound characteristics of the strikers.

The base control enclosure could have a magnetic coupling in place of the mating disconnecting coupling halves 26 & 55 (shown in FIG. 1*a* & 1*b* respectively), or multiple bearings on the rotatable hub shaft 54.

The design of a control enclosure 10 which controls a detachable module lends itself to allow for multiple module configurations. Modules can be designed for various tube types and geometries. These modules could be designed to use a smaller or larger tube type having an adjusted hub height, smaller or larger strikers, and smaller or larger cylindrically cut holes. A module may be designed for many tubes to be processed at once. Modules can have varying patterns or layouts for tube locations. A module may have more cylindrically cut holes and strikers installed on its hub, relative to the shown embodiment. More strikers will be present if a higher quantity range of tubes are desired. The strikers' quantity, length, mass, shape and placement (altering the impact location) can be preset for each module optimizing their use with a particular tube geometry. These variances in the design of each module would exist to both optimize results and simplify operation for the user. The user would simply choose an appropriate module for the desired operation.

The protective sleeve can have multiple versions and geometries to accommodate different tube sizes and types. A protective sleeve may account for many, if not all, tube geometries. The defining characteristics of the protective sleeve include a casing whose walls surround and encompass a tube held within, providing protection for the tube from direct impact with the strikers and additionally have a mechanism for mounting the protective sleeve within the impact zone of the strikers, while still allowing for the necessary range of movement for said protective sleeve.

There may be additional embodiments of the tube retaining platform. For example, the tube retaining platform may have spokes or projections which extend partly or completely through the bottom opening, a ring which acts as a shelf for the tube to sit, or solid wall, all of which would be intended to prevent the tube from falling through a hole. Other variations could include one or more varieties of caps to cover the top of the tube, or additional mounting mechanisms intended to hold the sleeve in place instead of utilizing a shelf.

The threshold in 102*i* can be varied to adjust the faulting sensitivity from module to module or changed based on the determined number of tubes.

Another embodiment uses a sensing circuit to measure the instantaneous velocity of the strikers. The mathematical calculation for the necessary target RPM could use a look up table or a mathematical formula. The table or formula be used to compensate for the content in the tubes, thereby having the strikers impact with greater force if the content in the tube has more mass or exhibits more resistance to the impacts.

In another embodiment the removable module performs the mathematical calculation for the necessary target RPM.

Another embodiment uses a sensing circuit to measure the rotational velocity of the hub or count the rotations of the hub in a given time period, and compensate for the load in the unit. The hub could be driven at a greater speed and/or with more torque and/or more time to compensate for more tubes and/or more mass in the tubes. Additionally a user could directly select a particular rotational velocity.

CONCLUSION, RAMIFICATIONS AND SCOPE

Accordingly, the reader will see that at least one embodiment of the described agitation apparatus can be used to provide protection for tubes allowing for tube contents to be agitated with greater force, can lessen the risk of tube caps loosening or opening and can limit heat build-up and excess noise. In addition, at least one embodiment of the described agitation apparatus can use interchangeable modules to allow for the use of a variety of tube types, and feedback sensors to control consistency of the agitation of tube contents per user setting, and to automatically stop agitation in the case of tube failure.

While the above description contains many specificities, these should not be construed as limitations on the scope of the embodiments, but rather as providing illustrations of some of several embodiments. The scope of the embodiments should be determined by the appended claims and their legal equivalent, rather than by the examples given.

We claim:

1. An apparatus for agitating material contained in tubes, comprising a motor and a removable module, said module including: one or more strikers; means for connecting said one or more strikers to said motor for rotating said one or more strikers; a tube supporting structure capable of holding said tubes; and said one or more strikers being positioned to impact said tubes upon rotation, wherein said one or more strikers are connected to said motor by a rotatable hub and can independently pivot laterally from said hub.

2. An agitation apparatus according to claim 1, further including a sensing circuit for detecting the presence of and identifying said module.

3. An agitation apparatus according to claim 1, further including a locking lid.

4. An agitation apparatus according to claim 1 wherein said rotatable hub is connected to said motor via mating coupling halves.

5. An agitation apparatus according to claim 1 wherein said rotatable hub is connected to said motor via magnetic coupling.

6. An agitation apparatus according to claim 1, further including a sensing circuit to monitor the movement of said strikers.

7. An agitation apparatus according to claim 1, further including one or more protective sleeves having spaces within for said tubes.

8. An apparatus for agitating material contained in tubes, comprising: a motor; one or more strikers; said motor connected to said one or more strikers for rotating said one or more strikers; a sensing circuit to monitor the movement of said one or more strikers; and a tube supporting structure for holding said tubes wherein said one or more strikers are connected to said motor by a rotatable hub and can independently pivot laterally from said hub.

9. An agitation apparatus according to claim 8 wherein said sensing circuit monitors the movement of said one or more strikers by measuring the velocity of said one or more strikers.

10. An agitation apparatus according to claim 8 wherein said one or more strikers are connected to said motor by means of a rotatable hub, and wherein said sensing circuit monitors the movement of said one or more strikers by measuring the rotational velocity of said rotatable hub.

11. An agitation apparatus according to claim 8 wherein said sensing circuit monitors the movement of said one or more strikers by measuring the rebound of said one or more strikers after impacting said tubes.

12. An agitation apparatus according to claim 8, further including one or more protective sleeves having spaces within, for said tubes.

13. An agitation apparatus according to claim 7 wherein said protective sleeve is composed of flexible plastic allowing said protective sleeve to deform on impact.

14. An agitation apparatus according to claim 1 further including a tube retaining platform to support said tube.

15. An agitation apparatus according to claim 14 wherein said tube retaining platform has a flexible open structure.

16. An agitation apparatus according to claim 7 further including a flange or lip for hanging said protective sleeve from a cylindrically cut hole.

17. An agitation apparatus according to claim 7 wherein said sleeve has a cap for retaining said tube within said protective sleeve.

* * * * *